US011445831B2

(12) United States Patent
Bhat et al.

(10) Patent No.: US 11,445,831 B2
(45) Date of Patent: Sep. 20, 2022

(54) ADJUSTABLE MATTRESS ASSEMBLY

(71) Applicant: PRS Medical Technologies, Inc., Menlo Park, CA (US)

(72) Inventors: Nikhil Bhat, Fremont, CA (US); George Y. Choi, Menlo Park, CA (US); Robert A. Brommer, Fremont, CA (US); Allen J. Li, San Francisco, CA (US)

(73) Assignee: PRS Medical Technologies, Inc., Menlo Park, CA (US)

( * ) Notice: Subject to any disclaimer, the term of this patent is extended or adjusted under 35 U.S.C. 154(b) by 17 days.

(21) Appl. No.: 16/875,623

(22) Filed: May 15, 2020

(65) Prior Publication Data

US 2020/0345151 A1 Nov. 5, 2020

Related U.S. Application Data

(63) Continuation of application No. 15/344,172, filed on Nov. 4, 2016, now Pat. No. 10,653,247.

(60) Provisional application No. 62/251,471, filed on Nov. 5, 2015.

(51) Int. Cl.
*A47C 27/10* (2006.01)
*A47C 27/08* (2006.01)

(52) U.S. Cl.
CPC ..... *A47C 27/10* (2013.01); *A47C 27/081* (2013.01); *A47C 27/085* (2013.01)

(58) Field of Classification Search
CPC ..... A47C 27/10; A47C 27/08; A47C 27/081; A47C 27/085
See application file for complete search history.

(56) References Cited

U.S. PATENT DOCUMENTS

| | | | | |
|---|---|---|---|---|
| 5,333,921 | A * | 8/1994 | Dinsmoor, III ..... | A61G 5/1043 297/219.1 |
| 6,519,797 | B1 | 2/2003 | Brubaker et al. | |
| 8,656,919 | B2 | 2/2014 | Bhat et al. | |
| 8,776,798 | B2 | 7/2014 | Choi et al. | |
| 8,887,732 | B2 | 11/2014 | Choi et al. | |
| 9,021,637 | B1 * | 5/2015 | Whelan ..... | A61G 5/1045 5/654 |
| 9,320,666 | B2 | 4/2016 | Bhat et al. | |
| 9,326,905 | B2 | 5/2016 | Bhat et al. | |
| 9,339,407 | B2 | 5/2016 | Bhat et al. | |
| 9,456,943 | B2 | 10/2016 | Bhat et al. | |
| 10,653,247 | B2 | 5/2020 | Bhat et al. | |
| 2011/0173758 | A1 | 7/2011 | Fontaine | |
| 2013/0081208 | A1 | 4/2013 | Dyevich et al. | |
| 2017/0127845 | A1 | 5/2017 | Bhat et al. | |

* cited by examiner

*Primary Examiner* — Fredrick C Conley
(74) *Attorney, Agent, or Firm* — Levine Bagade Han LLP

(57) ABSTRACT

Adjustable mattress assemblies are described in which a mattress incorporates regions where additional pressure reduction is adjustable via pliable fluid bladders filled with a gas or fluid. Such areas of the mattress where additional pressure reduction is desired may include regions of the mattress which support areas of the body which may be particularly susceptible to pressure ulcers such as the heels, sacral regions, etc.

23 Claims, 4 Drawing Sheets

ADJUSTABLE MATTRESS ASSEMBLY

CROSS-REFERENCE TO RELATED APPLICATIONS

This application is a continuation of U.S. patent application Ser. No. 15/344,172 filed Nov. 4, 2016, which claims the benefit of priority to U.S. Provisional Application No. 62/251,471 filed Nov. 5, 2015, each of which is incorporated herein by reference in its entirety for all purposes.

FIELD OF THE INVENTION

The present invention relates to adjustable mattress supports. More particularly, the present invention relates to mattress supports which incorporate a support assembly which is adjustable in positioning and/or pressure support for preventing and/or treating pressure ulcers.

BACKGROUND OF THE INVENTION

Individuals who are forced to sit or lie down for extended periods of time typically experience tissue necrosis over localized regions of their body known as decubitus ulcers or pressure sores. Pressure ulcers generally occur at locations of the body where the bony prominence is high and the underlying skin breaks down when constant pressure is placed against the skin. Blood circulation is inhibited or prevented in these localized areas and can even occur when the patient has been lying against or upon cushioning devices. Examples of areas of the body where pressure sores typically occur include the sacrum, greater trochanter, ischial tuberosity, malleolus, heel, etc. When pressure ulcers form, they can lead to extensive stays in the hospital or even to amputation.

Conventional cushioning devices generally utilize flexible materials such as foam or springs which allow for the cushion to deform and conform to the patient's body. While the cushioning device attempts to redistribute the loading from localized regions of the patient's body to a larger area over the rest of the body, such devices typically bottom out such that the patient's body contacts the underlying platform and nonetheless localizes the pressure onto the body.

Other cushioning devices have utilized fluid-filled cushions which consist of large single bladders or compartmentalized fluid or gas-filled bladders which inhibit fluid contained within the bladders from flowing laterally. In a fluid filled bladder disposed on a contoured seat, the fluid filled bladder typically bottoms out in one or more areas when supporting a patient's body weight. The places where the bladder bottoms out are sources of high localized pressure. Thus, such an assembly does not distribute pressure evenly across the portions of the anatomy in contact with the bladder. The amount of water that is used in such a bladder can be increased such that bottoming out does not occur. However, this design sacrifices stability. Additionally, since such cushions are typically designed to accommodate a wide range of patient populations, patients who are not as heavy as the maximum for which the cushion or mattress was designed for will suffer even more lack of stability than would be needed.

Another problem with simply increasing the amount of fluid to prevent bottoming out is that this requires significant volume of fluid beneath the patient and/or require specialized bedding. Additionally, many fluid filled membranes are too thick to provide adequate pressure relief because the hammocking that occurs in the regions of high protrusions.

Thus, the suspension of the patient's body typically results in significantly non-uniform pressure application, with higher pressures being applied to protruding portions of the patient's body due to lack of adequate conformance of the bladder material to the patient's body.

Yet other support devices utilize segmented bladders in an attempt to isolate individual bladders from one another. Yet such segmented supports may fail to allow for the cushion to fully conform to the patient's body as fluid between each of the segmented cushions is prevented.

Accordingly, there exists a need for a cushioning device which may conform to regions of the patient's body to prevent decubitis ulcers in a manner which is more cost efficient, convenient, and effective.

SUMMARY OF THE INVENTION

A mattress having an adjustable support may be sized and dimensioned to the approximate thickness, length, and width of standard conventional mattresses to be compatible with most beds but in regions where additional pressure reduction is desired, pliable fluid bladders filled with a gas or fluid (e.g., air, water, oil such as mineral oil, or other fluids) can be incorporated within the primary mattress construction. Such areas of the mattress where additional pressure reduction is desired may include regions of the mattress which support areas of the body which may be particularly susceptible to pressure ulcers such as the heels, sacral regions, etc.

One variation of a mattress assembly which is configured for alleviating pressure on the heels of a user may define a surface or platform upon which the user may lie and an adjustable support assembly may be incorporated into the distal portion of the mattress assembly. As the user lies upon the surface, their thighs may come to rest upon a first surface and the weight of the user's thighs may exert an applied weight upon the first surface causing the support assembly to rotate about its pivot such that a second surface exerts a corresponding counter force up against the calf region to lift the user's lower legs and thereby reducing the pressure on their heels. An optional counterweight (which may be adjustable) may be incorporated into the support assembly beneath the second surface to counter balance the relatively greater weight of the calves or other parts of the legs to ensure that the second surface does not push up excessively onto the heels of the user.

Another variation of a mattress assembly similarly having a surface or platform may be optionally angled to accommodate the heels of the user. The mattress assembly may incorporate an adjustable support assembly in the distal portion such that the support assembly is in communication with one or more fluid elements or pods integrated within the surface over a support region located proximal to the support assembly. The support region may be positioned proximal to the support assembly such that the thighs or lower legs of the user may lie upon the support region while the feet and heels of the user extend over and upon the support assembly. The pods may be aligned uniformly or arbitrarily within the support region so that the pods are positioned to extend upon the surface or partially above the surface for contacting the legs of the user.

Yet another variation of a mattress assembly may have a support assembly incorporated along the surface or platform at a region where the user's sacral region would rest when the user lies upon the surface. The support assembly may be contained and secured within a base, e.g., foam base, which may also define a recess or receiving channel which contains and secures the support assembly within.

Any of the variations described herein may optionally incorporate an active control system which may use pressure monitoring circuitry to maintain fluid pressures required for the pressure reduction pliable bladders to remain effective. The liquid filled elements could be supported or contained with, e.g., air filled or mechanical adjusters or limiters, and the circuitry could intermittently drive pumps and valves to increase the bladder pressures as necessary.

In one variation, an adjustable mattress assembly may generally comprise a mattress defining a surface for supporting a user, a support assembly defining a first surface and a second surface, wherein the support assembly is pivotably attached to the mattress such that the second surface is positioned at a distal portion of the mattress, and wherein a pressure exerted upon the first surface by a first region of the user corresponds to a counterforce exerted by the second surface against a second region of the user.

In another variation, the adjustable mattress assembly may generally comprise a mattress defining a surface for supporting a user, one or more fluid-filled elements positioned along a support region of the mattress, a support assembly positioned along the mattress distal to the one or more fluid-filled elements, and a transfer bladder having a first portion configured to receive an applied pressure from the one or more pods and further having a second portion configured to transmit the applied pressure to the support assembly.

In yet another variation, the adjustable mattress assembly may generally comprise a mattress defining a surface for supporting a user and further defining a channel along a region of the mattress for supporting a sacral region of the user, a first bladder positioned within the channel, a second bladder positioned within the channel beneath the first bladder, and one or more fluid-filled elements positioned between the first and second bladders.

In yet another variation, one method for adjusting the mattress in response to a user may generally comprise positioning a first region of a body of the user upon a first surface of the mattress, receiving a pressure exerted upon the first surface of the mattress by the first region of the body, transferring the pressure via a support assembly to a second surface of the mattress, wherein the second surface is distal to the first surface, and exerting a counterforce via the second surface against a second region of the body, wherein the counterforce corresponds to the pressure exerted upon the first surface.

DETAILED DESCRIPTION OF THE INVENTION

A mattress having an adjustable support may be generally constructed of, e.g., an appropriately dense open-celled foam or a combination of foam densities, and regions of variable compressibility (e.g., air spaces). Such a mattress may be sized and dimensioned to the approximate thickness, length, and width of standard conventional mattresses to be compatible with most beds, e.g., hospital beds, and safety rails as well as fit with most commercially available covers of different size mattresses. In regions where additional pressure reduction is desired, pliable fluid bladders filled with a gas or fluid (e.g., air, water, oil such as mineral oil, or other fluids) can be incorporated within the primary mattress construction. Such areas of the mattress where additional pressure reduction is desired may include regions of the mattress which support areas of the body which may be particularly susceptible to pressure ulcers such as the heels, sacral regions, etc.

A number of additional or secondary fluid bladders that are either integral or discrete and layered may be used to contain the fluid within the region of pressure reduction by increasing contact with both the user and the primary fluid bladder. Examples and details of some variations of the support assembly which may be used with the assemblies and features described herein and in any number of combinations may be seen in the following U.S. Pat. Nos. 8,656,919; 8,776,798; 8,887,732; 9,320,666; 9,326,905; 9,339,407; 9,456,943. Each of these references is incorporated herein by reference in its entirety and for any purpose herein.

Figure 1:
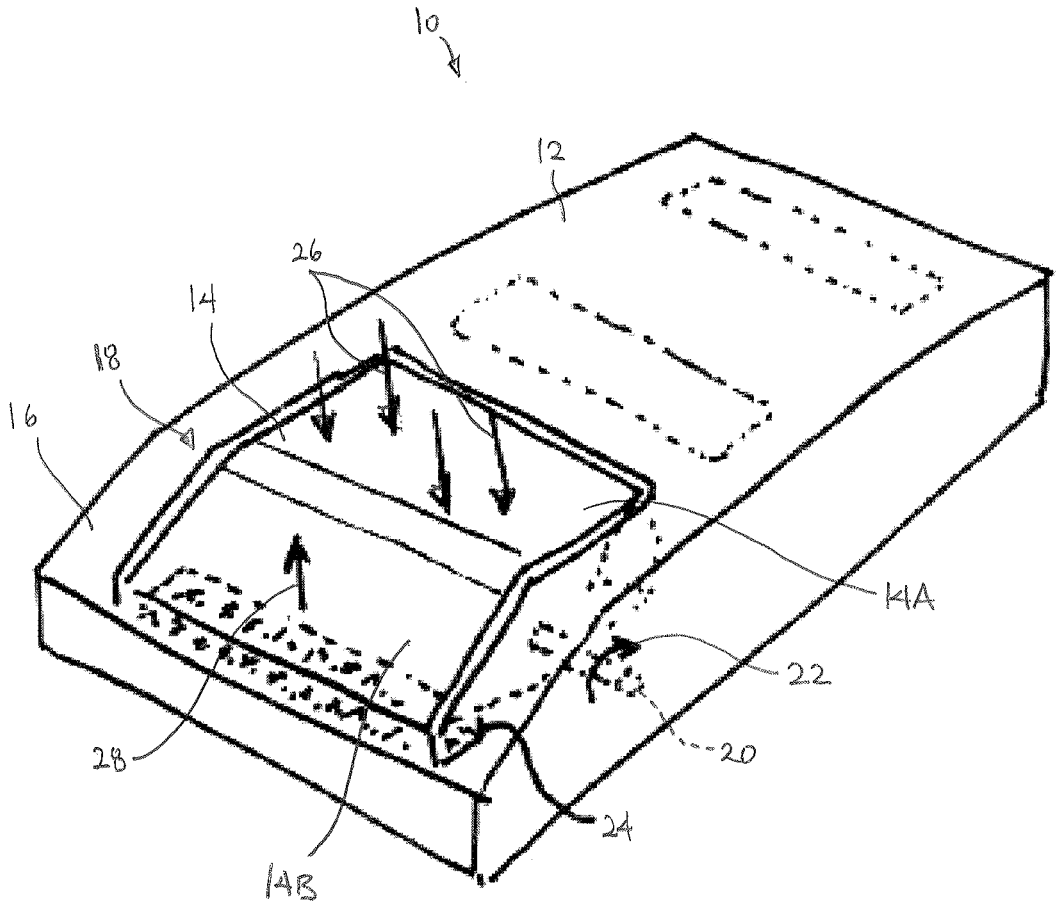
FIG. 1 shows a perspective view of a mattress assembly having an adjustable support configured with a counterweight mechanism for supporting the heels of a user.

One variation of a mattress assembly 10 which is configured for alleviating pressure on the heels of a user is shown in the perspective view of FIG. 1. The mattress assembly 10 may define a surface or platform 12 upon which the user may lie and an adjustable support assembly 14 may be incorporated into the distal portion 16 of the mattress assembly 10. The distal portion of the mattress is designated as the end of the mattress assembly 10 where the feet and legs of the user would normally be positioned or aligned while the proximal portion of the mattress is designated as the opposite end of the mattress assembly 10 where the head of the user would normally be positioned or aligned.

The distal portion 16 incorporating the support assembly 14 may be optionally angled relative to the surface 12 such that a downward slope, e.g., anywhere between 3° to 30°, is defined to minimize the interface with the heels of the user when lying upon the surface 12. In other variations, the distal portion 16 of the mattress assembly 10 may have a level top surface instead of a sloping section. The support assembly 14 may be incorporated into a recess or receiving channel 18 which is defined within the mattress assembly 10 such that a first surface 14A of the support assembly 14 presents an area which is level with the rest of the surface 12. The support assembly 14 may further define a second surface 14B which presents a sloping area with the distal portion 16. The second surface 14B may present an area which is sufficiently large enough to support the heels of the user when resting upon the surface 12 and the first surface 14A may be sized and configured so as to support the legs and/or thighs of the user.

The first and second surfaces 14A, 14B of the support assembly 14 may form an integrated support which is coupled to the mattress assembly 10 at least in part by a pivot 20 which allows the mattress assembly 10 to rotate at least partially, as shown by the direction of rotation 22, such that the first and second surfaces 14A, 14B can tilt and angle relative to the surface 12 and distal portion 16. As the user lies upon the surface 12, their thighs may come to rest upon the first surface 14A. The weight of the user's thighs may exert an applied weight 26 upon the first surface 14A causing the support assembly 14 to rotate about its pivot 20 in the direction indicated 22 such that the second surface 14B exerts a corresponding counterforce 28 up against the calf region to lift the user's lower legs and thereby reducing the pressure on their heels. An optional counterweight 24 (which may be adjustable) may be incorporated into the support assembly 14 beneath the second surface 14B to counter balance the relatively greater weight of the calves or other parts of the legs to ensure that the second surface 14B does not push up excessively onto the heels of the user.

The first and second surfaces 14A, 14B of the support assembly 14 may also optionally incorporate a cushioning support to provide additional comfort and support to the heels and legs of the user. Accordingly, any of the cushioning support assemblies described herein may be incorporated into the mattress assembly 10 and support assembly 14.

Figure 2A:
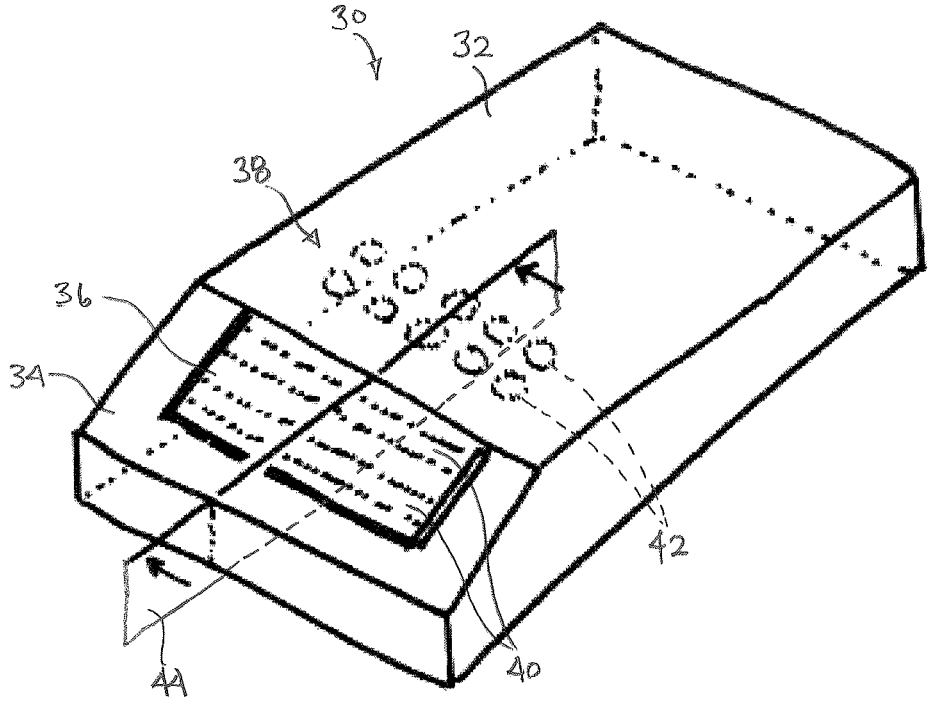
FIG. 2A shows a perspective view of another mattress assembly having several bladders configured to transfer pressure between regions of the body.

Another variation is shown in the perspective view of FIG. 2A of a mattress assembly 30 similarly having a surface or platform 32 upon which the user may lie upon and a distal portion 34 which may be optionally angled in the manner described above to accommodate the heels of the user. The mattress assembly 30 may incorporate an adjustable support assembly 36 in the distal portion 34 such that the support assembly 36 is in communication with one or more fluid elements or pods 42 integrated within the surface 32 over a support region 38 located proximal to the support assembly 36. The support region 38 may be positioned proximal to the support assembly 36 such that the thighs or lower legs of the user may lie upon the support region 38 while the feet and heels of the user extend over and upon the support assembly 36. The pods 42 may be aligned uniformly or arbitrarily within the support region 38 so that the pods 42 are positioned to extend upon the surface 32 or partially above the surface 32 for contacting the legs of the user. Moreover, the pods 42 may be positioned to contact an adjacent pod to allow for the transmission of the pressure between the pods themselves or, alternatively, they may be separated from one another such that the pressure is transmitted through the pods 42 and directly to the underlying transfer bladder 48, as described in further detail herein.

Each of the pods 42 may be filled with a fluid, e.g., an incompressible liquid such as water, viscous oil, or some other biocompatible liquid. Yet in other variations, the pods 42 may be filled alternatively with a gas such as air, nitrogen, etc. In yet additional variations, the one or more pods 42 may be filled with either a liquid or gas or a combination of both depending upon the desired degree of cushioning and force distribution. The use of a gas in the supports may reduce the overall weight of the mattress system and allow for a more compliant system, if desired. The fluid may be a low density fluid with a specific gravity of less than 0.9 or with a specific gravity of less than 0.7. The pods and/or fluid pads may contain solids in addition to fluid. Examples of such solids include glass microspheres. The solid may have a specific gravity of less than 0.9 or less than 0.7. Using low density materials can reduce the weight of the apparatus without reducing its size.

The one or more fluid pods may each occupy an envelope of, e.g., 1 cm×1 cm×0.5 cm to about 3 cm×3 cm×3 cm, in an uncompressed state and they may be formed into various shapes, e.g., spherical, cylindrical, cubical, etc. Moreover, each of the pods may be formed from various materials such as polyurethane, silicone, vinyl, nylon, polyethylene vinyl acetate (PEVA), etc. having a thickness ranging from, e.g., 0.1 mm to 5 mm. Although the figure illustrates ten pods, the number of pods may range anywhere from, e.g., 1 to 30 or more, arranged either uniformly or arbitrarily upon the support region 38.

The support assembly 36 may comprise a bladder filled with a fluid, e.g., an incompressible liquid such as water, viscous oil, or some other biocompatible fluid, or with a gas such as air, nitrogen, etc., or with a combination of both a liquid and a gas. In any case, the support assembly 36 may form one or more baffles 40 which extend laterally across the support assembly 36. These baffles 40 may extend at least partially or across the entire length of the support assembly 36 to provide the cushioning support by the contained fluid over the entire area of the assembly 36 by minimizing pooling of the fluid at the end of the support assembly 36.

There are several aspects of safety associated with the fluid filled bladders and pods which relate to the proper selection of fluid that does not promote significant long-term biological growth and would not be a skin irritant if the primary containment of the bladders and pods were to fail and expose the user to the fluid. There may also be a puncture potential as with all fluid filled mattresses that may be identified in warnings provided to the user. Also, containment pans may be incorporated below the fluid bladders and pods or loose outer containment bags sealed around the bladders and pods within the mattress to help limit spillage and migration of the fluid if a puncture or bladder seam failure were to occur.

Figure 2B:
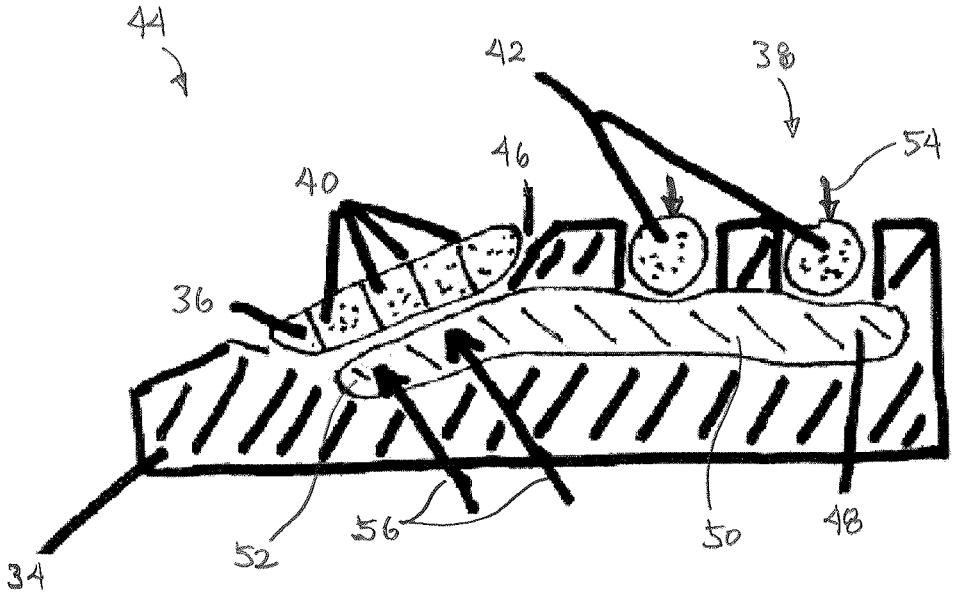
FIG. 2B shows a cross-sectional side view of the adjustable support assembly of FIG. 2A.

FIG. 2B shows cross section 44 from FIG. 2A illustrating how the baffles 40 may be arranged within the support assembly 36. As shown, the support assembly 36 may be contained within a recess or receiving channel 46 to secure a position of the support assembly 36. Also shown are the pods 42 which are arranged along the support region 38 for contact against the user's body. A transfer bladder 48 may be contained within the support assembly 36 so that it extends beneath both the pods 42 and the support assembly 36. The transfer bladder 48 may similarly be filled with a fluid, e.g., an incompressible liquid such as water, viscous oil, or some other biocompatible fluid, or with a gas such as air, nitrogen, etc., or with a combination of both a liquid and a gas. As the user lays their legs or body upon the pods 42 and upon support region 38, the applied weight 54 may press upon a first portion 50 of the transfer bladder 48 which transmits the pressure through the contained fluid and into a second portion 52 of the transfer bladder 48. This transferred pressure may then apply a counter force 56 exerted upon the overlaid support assembly 36 such that the support assembly 36 is urged to extend and push up against the heels of the user and provide additional cushioning support.

As previously mentioned, the first and second surfaces 14A, 14B of the support assembly 14 shown in FIG. 1 may also optionally incorporate the support assembly 36, pods 42, and transfer bladder 48 described to provide additional comfort and support to the heels and legs of the user.

Figure 3A:
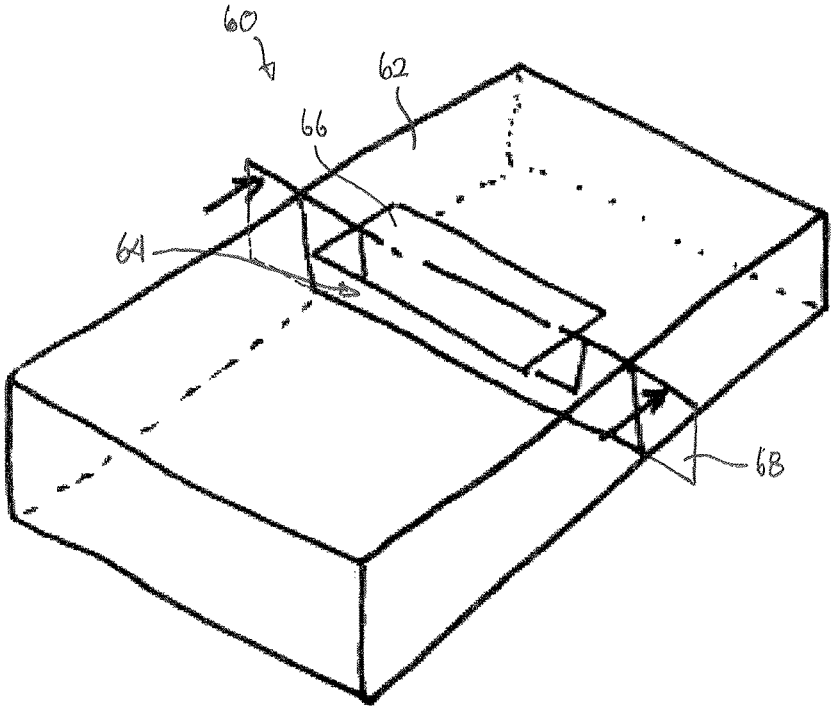
FIG. 3A shows a perspective view of another mattress assembly having an adjustable support assembly with several bladders for supporting the sacral region of the user.
Figure 3B:
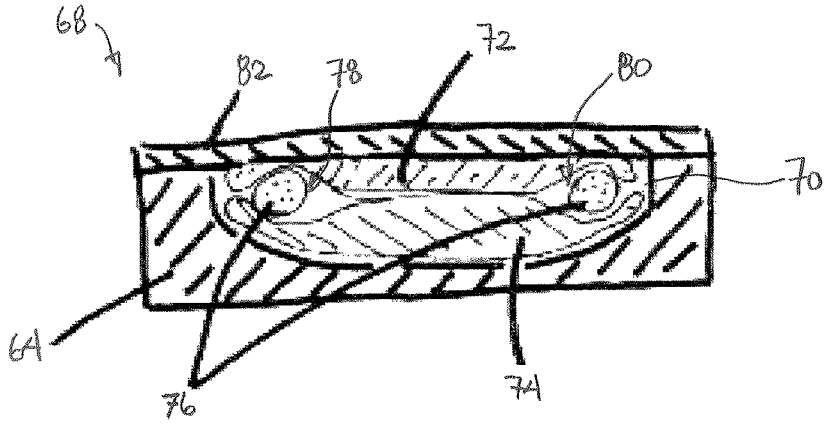
FIGS. 3B and 3C show cross-sectional transverse views of alternative adjustable support assemblies for the mattress of FIG. 3A.

Yet another variation of a mattress assembly 60 which is configured for alleviating pressure on the sacral region of a user is shown in the perspective view of FIG. 3A. With this variation, the support assembly 66 may be incorporated along the surface or platform 62 at a region where the user's sacral region would rest when the user lies upon the surface 62. The support assembly 66 may be contained and secured within a base 64, e.g., foam base, which may be seen in the cross section 68 shown in FIG. 3B. The base 64 may define a recess or receiving channel 70 which contains and secures the support assembly 66 within.

As shown, a first bladder 72 may extend within the channel 70 positioned upon a second bladder 74 which rests beneath against the bottom of the channel 70. One or more of the fluid elements or pods 76, as described above, may be positioned on either end of the channel 70 along a first end 78 and a second end 80 which is opposite to the first end 78 such that the pods 76 align along the sides of or beneath the user's sacral region when laying upon the support assembly 66. A top cushioning layer 82, e.g., foam layer, may be overlaid upon the first bladder 72 and may extend over the support assembly 66 or the entire surface 62 to provide additional cushioning support to the user as well as helping to displace the weight of the user over the support assembly 66 and underlying bladders 72, 74 and pods 76.

Figure 3C:
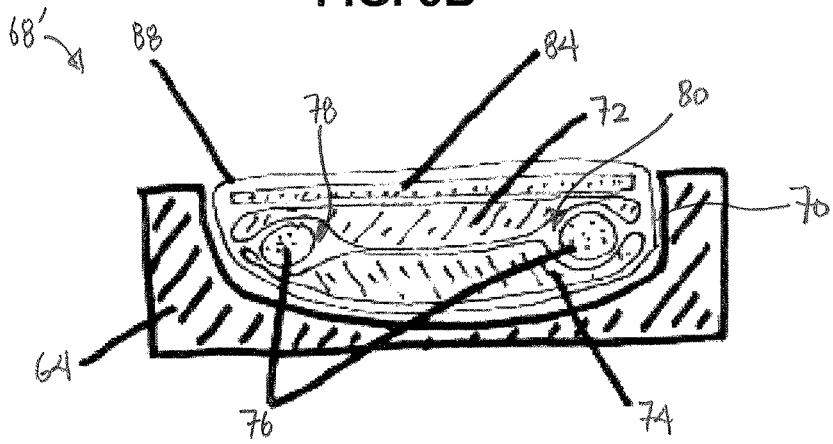

An alternative variation of the cushioning support is shown in the cross sectional view 68' of FIG. 3C. In this embodiment, an insulation layer 84 may be overlaid upon the first bladder 72 and the bladders 72, 74 and pods 76 may be contained within a compliant covering 88. The covering 88 may encase the pods and help to contain the expansion and transfer of pressure via the bladders 72, 74 and pods 76.

This assembly, when compressed, would apply restrictions to fluid migration in the second bladder 74 and force the fluid back to the center where it could be useful to distribute the forces at the interface with the user. Also, the interface shape between the base 64 and the bladders 72, 74 will have an effect on the efficiency of the fluid bladders 72, 74. Angled foam interfaces at the edges of the bladders 72, 74 may help to keep the fluid bladders 72, 74 from easily migrating out of the channel 70 and onto the flat, upper surface 62 of the mattress. This style of interface would also reduce the edge effect between the pressure reduction area at the bladder region and the foam that may be sensed on the back as a discontinuity in the pressures.

While a two bladder design is shown, variations that would be functional also include a single bladder design where the top layer of the bladder is relatively less compliant and is used to compress the pods 76 to keep the main bladder from bottoming out. A combination of layers could also be used in the sacral region of the mattress to reduce pressure. As the mattress assembly has an adjustable interface that has several elements above the level of a conventional mattress, part of the intent of an integrated system is to reduce the profile to appear as a conventional mattress. Furthermore, additional pliable fluid bladders or additional fluid volume may be implemented to obtain the same pressure reduction over a wide range of users.

The variation shown in FIG. 3C may optionally include or omit the top cushioning layer 82. Additionally, either of these variations for cushioning the sacral region may be incorporated in combination with any of the support assemblies described herein so that the mattress may provide support not only to the sacral region but also to the heel region as well.

Any of the variations described herein may also optionally incorporate an active control system which may use pressure monitoring circuitry to maintain fluid pressures required for the pressure reduction pliable bladders to remain effective. The liquid filled elements could be supported or contained with, e.g., air filled or mechanical adjusters or limiters, and the circuitry could intermittently drive pumps and valves to increase the bladder pressures as necessary.

Figure 4:
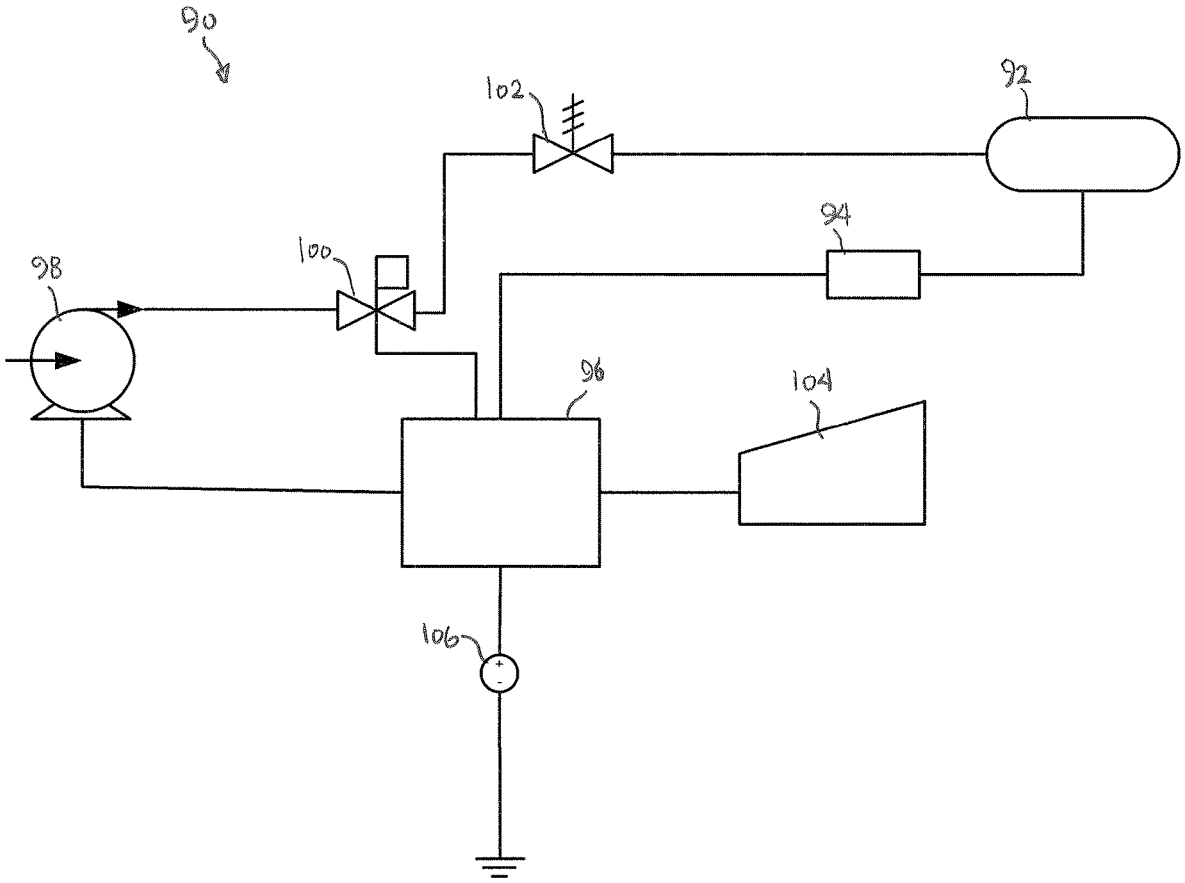
FIG. 4 shows one variation of a block diagram for a bladder control system.

A schematic diagram of one example of an active control system 90 for controlling and adjusting, e.g., a pressure within any of the bladders in any of the assemblies described herein, is illustrated in FIG. 4. In this variation, a single bladder 92 is illustrated although other variations of control systems may be used to control and adjust multiple bladders. The bladder 92 may be fluidly coupled to a pressure transducer 94 used to monitor the pressure within the bladder 92 and which is also in communication with a control unit 96, e.g., a programmable processor, incorporated into the mattress assembly or positioned remote from the mattress.

A pump 98, e.g., air pump, may be in communication with the control unit 96 and may also be fluidly coupled to the bladder 92 to provide for the addition or removal of fluid from the bladder 92. A control valve 100 is also in communication with the control unit 96 and may be actuated by the control unit 96 to provide for the flow of fluid to or from the pump 98 and to the bladder 92. An additional over-pressure relief valve 102, e.g., mechanical relief valve, may also be in fluid communication between the control valve 100 and bladder 92. The over-pressure relief valve 102 may be set to open at a predetermined pressure level to ensure that the bladder 92 is not over-inflated or overly compressed.

An input control 104, e.g., automated or manual input control for increasing or decreasing pressure, may also be in electrical communication with the control unit 96 to provide the user an interface for controlling parameters in the control unit 96 such as pressure levels. A power supply 106, e.g., isolated DC power supply, may be in electrical communication not only with the control unit 96 but also with other components such as the pump 98 and input control 104 to provide the requisite power.

If active systems are applied to the mattress system, they would be assessed for safety to limit any potential harm that they may cause to the user if a single fault condition were to arise during their use.

The applications of the devices and methods discussed above are not limited to applications for particular regions of the body such as the sacrum, trochanter, heel, etc. but may include any number of further applications and cushioning supports. Modification of the above-described device and methods for carrying out the invention, and variations of aspects of the invention that are obvious to those of skill in the art are intended to be within the scope of the claims.

What is claimed is:

1. A cushion assembly comprising:

a first support;

a second support moveable relative to the first support;

a first fluid filled pod; and a second fluid filled pod, wherein when the cushion assembly is in an assembled configuration, the second support is in a recess of the first support, wherein when a first force is applied to the first support by a person, a second force is exertable against the person by the second support, and wherein a width of a space between the first fluid filled pod and the second fluid filled pod is greater than a width of the first fluid filled pad or a width of the second fluid filled pod.

2. The cushion assembly of claim 1, wherein the width of the space between the first fluid filled pod and the second fluid filled pod is greater than the width of the first fluid filled pad and the width of the second fluid filled pod.

3. The cushion assembly of claim 1, wherein when the cushion assembly is in the assembled configuration, the cushion assembly has a non-weight bearing configuration and a weight bearing configuration, and wherein when the cushion assembly is in the weight bearing configuration, the second support is closer to a longitudinal center of the first support than when the cushion assembly is in the non-weight bearing configuration.

4. The cushion assembly of claim 1, wherein when the cushion assembly is in the assembled configuration, the second support is coupled to the first support.

5. The cushion assembly of claim 4, wherein the second support is rotatable relative to the first support.

6. The cushion assembly of claim 1, wherein when the cushion assembly is in the assembled configuration, the first fluid filled pod is between the second support and a proximal terminal end of the cushion assembly, and wherein when the cushion assembly is in the assembled configuration, the second support is closer to a distal terminal end of the cushion assembly than the proximal terminal end of the cushion assembly.

7. The cushion assembly of claim 1, wherein when the cushion assembly is in the assembled configuration, the first support extends over the fluid filled pod.

8. The cushion assembly of claim 1, wherein when the cushion assembly is in the assembled configuration, the first support extends over the first fluid filled pod and over the second fluid pod.

9. The cushion assembly of claim 1, wherein the first fluid filled pod and the second fluid filled pod are on opposite ends of the cushion assembly.

10. The cushion assembly of claim 1, wherein the second support has a second support first surface and a second support second surface angled relative to the second support first surface, wherein when the first force is applied to the first support by the person, the second force is extertable against the person by the second support first surface, and wherein the second support second surface extends away from the second support first surface and toward a distal terminal end of the cushion assembly.

11. A cushion assembly comprising:

a first support;

a second support adjustable relative to the first support;

a first fluid filled pod; and a second fluid filled pod;

wherein when the cushion assembly is in an assembled configuration, the second support is in a recess of the first support, wherein force is transferrable from the first support to the second support via the first support, and wherein a distance between the first fluid filled pod and a distal terminal end of the first support is less than a distance between the first fluid filled pod and the second fluid filled pod.

12. The cushion assembly of claim 11, wherein a distance between the second fluid filled pod and a proximal terminal end of the first support is less than the distance between the first fluid filled pod and the second fluid filled pod.

13. The cushion assembly of claim 11, wherein when the cushion assembly is in the assembled configuration, the first support comprises a longitudinal center of the cushion assembly and the second support comprises a longitudinal end of the cushion assembly.

14. The cushion assembly of claim 11, wherein the first fluid pod is closer to the distal terminal end of the first support than the second fluid filled pod, and wherein the second fluid filled pod is closer to a proximal terminal end of the first support than the first fluid filled pod.

15. The cushion assembly of claim 14, wherein when the cushion assembly is in the assembled configuration, the first support extends over the first fluid filled pod and over the second fluid pod.

16. The cushion assembly of claim 14, wherein the first fluid filled pod and the second fluid filled pod are covered.

17. The cushion assembly of claim 14, wherein the recess is a first recess, wherein the first support further comprises a second recess, and wherein when the cushion assembly is in the assembled configuration, the first fluid filled pod is in the first recess and the second fluid filled pod is in the second recess.

18. The cushion assembly of claim 11, wherein when the cushion assembly is in the assembled configuration, the cushion assembly has a non-weight bearing configuration and a weight bearing configuration, and wherein when the cushion assembly is in the weight bearing configuration, the second support is closer to a longitudinal center of the cushion assembly than when the cushion assembly is in the non-weight bearing configuration.

19. A cushion assembly, wherein when the cushion assembly is in an assembled configuration, the cushion assembly comprises:

a first fluid filled layer separated by barriers;

a second fluid filled layer having baffles; and a third fluid filled layer, wherein force is transferrable from the first fluid filled layer to the third fluid filled layer, and wherein the second fluid filled layer is between the first fluid filled layer and the third fluid filled layer.

20. The cushion assembly of claim 19, wherein the first fluid filled layer, the second fluid filled layer, and the third fluid filled layer each comprises a liquid or a gas.

21. The cushion assembly of claim 20, wherein the liquid or the gas is on a first side and a second side of one of the barriers.

22. The cushion assembly of claim 21, wherein the first side is opposite the second side.

23. The cushion assembly of claim 19, wherein the first fluid filled layer comprises a liquid or a gas, wherein the second fluid filled layer comprises the liquid or the gas, and wherein the third fluid filled layer comprises the liquid or the gas.

* * * * *